US007578146B2

(12) United States Patent
Gustin

(10) Patent No.: US 7,578,146 B2
(45) Date of Patent: Aug. 25, 2009

(54) LOOM CLIP

(75) Inventor: Clella Gustin, Spanish Fork, UT (US)

(73) Assignee: Provo Craft and Novelty, Inc., Spanish Fork, UT (US)

( * ) Notice: Subject to any disclaimer, the term of this patent is extended or adjusted under 35 U.S.C. 154(b) by 0 days.

(21) Appl. No.: 12/127,244

(22) Filed: May 27, 2008

(65) Prior Publication Data

US 2008/0223083 A1 Sep. 18, 2008

Related U.S. Application Data

(63) Continuation-in-part of application No. 11/963,229, filed on Dec. 21, 2007, now Pat. No. 7,506,524.

(60) Provisional application No. 60/877,587, filed on Dec. 28, 2006.

(51) Int. Cl.
*D04B 3/00* (2006.01)

(52) U.S. Cl. ..... 66/1 A

(58) Field of Classification Search ..... 66/3, 66/4, 1 R

See application file for complete search history.

(56) References Cited

U.S. PATENT DOCUMENTS

| | | | | | |
|---|---|---|---|---|---|
| 1,500,383 | A | * | 7/1924 | Gourie | 66/4 |
| 1,694,849 | A | * | 12/1928 | Fujii | 66/4 |
| 1,705,860 | A | * | 3/1929 | Hagihara | 66/4 |
| 1,776,561 | A | * | 9/1930 | La Croix | 66/4 |
| 2,072,668 | A | * | 3/1937 | Eltgroth | 66/4 |
| 2,237,733 | A | * | 4/1941 | Grimm et al. | 66/4 |
| 2,270,619 | A | * | 1/1942 | Bowyer | 66/4 |
| 2,318,018 | A | * | 5/1943 | Semonsen | 66/4 |
| 3,678,709 | A | * | 7/1972 | Nowicki et al. | 66/4 |
| 3,967,467 | A | * | 7/1976 | Leach, Sr. | 66/4 |
| 4,158,296 | A | * | 6/1979 | Dunlop | 66/4 |
| 4,248,063 | A | * | 2/1981 | Wang | 66/4 |
| 4,393,668 | A | * | 7/1983 | Leach, Sr. | 66/4 |
| 4,729,229 | A | * | 3/1988 | Whicker | 66/4 |
| 5,231,742 | A | | 8/1993 | Macbain | |
| 5,413,150 | A | * | 5/1995 | Townsend | 139/34 |

OTHER PUBLICATIONS

International Search report from PCT/US2007/088629.

* cited by examiner

*Primary Examiner*—Danny Worrell
(74) *Attorney, Agent, or Firm*—Honigman Miller Schwartz and Cohn LLP

(57) ABSTRACT

A knitting loom clip includes a rigid member configured to be connected to a base structure of a knitting loom. The knitting loom clip includes a knitting peg attached. The knitting peg is configured to be positioned between two substantially parallel rows of knitting pegs on the knitting loom.

22 Claims, 4 Drawing Sheets

LOOM CLIP

TECHNICAL FIELD

This invention relates to a knitting loom clip and a method of using a knitting loom clip.

BACKGROUND

Weaving may utilize any number of different kinds of looms, ranging from simple hand held structures to complex machines. Looms commonly used today for non-commercial knitting include handlooms that may be rectangular, circular or oblong and have projecting pegs configured to hold the warp loops and the woven weft loops. An example of a rectangular loom includes the Knifty Knitter™ rectangle loom available from PROVO CRAFT®.

At least one advantage of handlooms is the ease of use and the ability of the user to utilize techniques that are more sophisticated as their skill with the loom increases. However, each type of handloom (e.g., circular, rectangular, oblong) does not provide for multiple uses. For example, a circular handloom is useful for circular knitting. However, the circular handloom does not provide for double knitting of straight pieces and may be difficult to use for single knit.

Therefore, users desiring to knit different styles of knits (e.g., single, double, circular knits) are required to purchase and carry both a circular handloom and a rectangular or elliptical loom. Moreover, the looms take up significant space and may be difficult to use in cramped quarters such as a car or an airplane.

Thus, there is a need for a handloom that is capable of producing different sized objects using a single loom. Moreover, it is desirable to provide a reconfigurable loom system providing for the knitting of multiple size objects.

BRIEF DESCRIPTION OF THE DRAWINGS

The features and inventive aspects will become more apparent upon reading the following detailed description, claims, and drawings, of which the following is a brief description:

DETAILED DESCRIPTION

Figure 1:
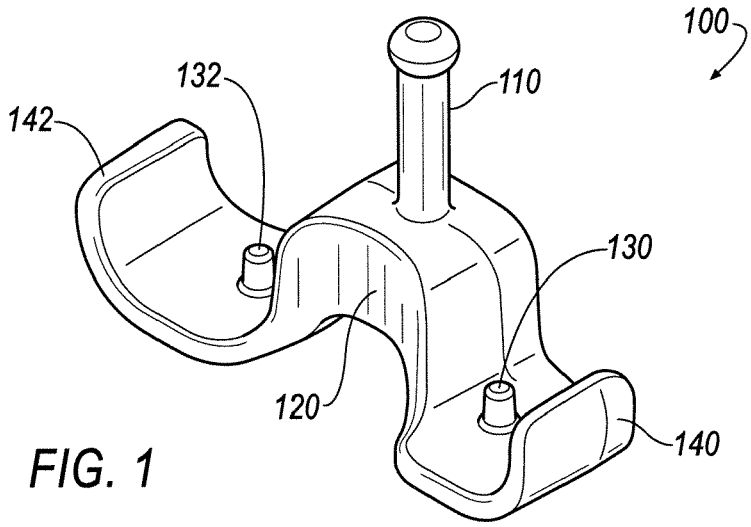
FIG. 1 is a perspective view of an example of a loom clip.
Figure 2:
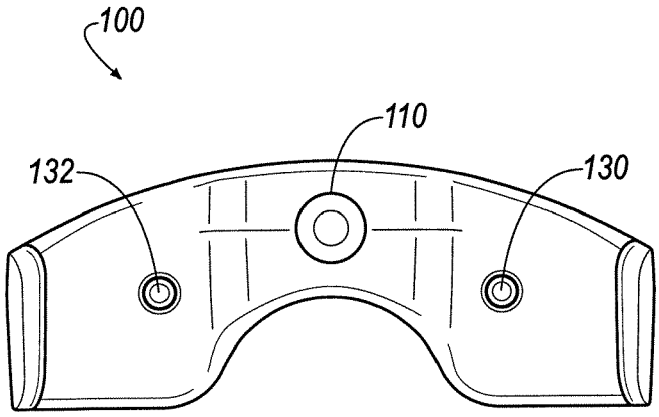
FIG. 2 is a top view of the loom clip of FIG. 1.
Figure 3:
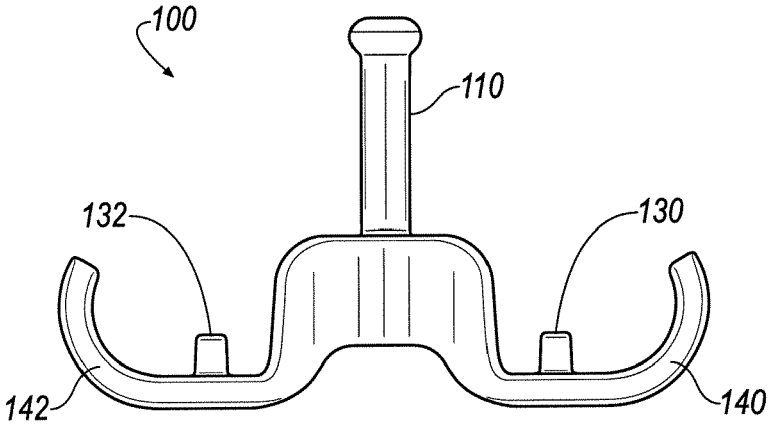
FIG. 3 is a front view of the loom clip of FIG. 1.
Figure 4:
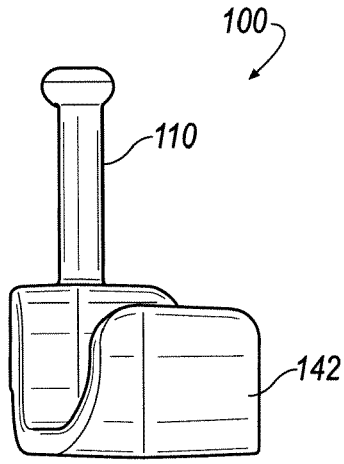
FIG. 4 is a side view of the loom clip of FIG. 1.

Referring now to the drawings, illustrative embodiments are shown in detail. Although the drawings represent the embodiments, the drawings are not necessarily to scale and certain features may be exaggerated to better illustrate and explain novel aspects of an embodiment. Further, the embodiments described herein are not intended to be exhaustive or otherwise limit or restrict the claims to the precise form and configuration shown in the drawings and disclosed in the following detailed description.

The examples discussed herein provide that a single handloom may perform single knit, double knit and circular knit. These looms are typically narrow and compact. They may be shaped, but not exclusively, as oblong, elliptical, and/or rectangular. The looms discussed herein may also be associated with a method of knitting that may include producing a closed circular knitting using a non-circular knitting loom. Moreover, as shown and described herein, a loom clip may be used to modify the overall length of the knitting region allowing for the knitting of different sized object using the same loom.

The examples discussed herein relate to a non-circular knitting loom. The loom includes a plurality of knitting pegs spaced generally equidistant relative to one another around the perimeter of the loom. The loom may provide for at least one knitting peg at one or more ends of the loom. Alternatively, the knitting peg may be located at the apex of the rectangle, ellipse, oval, rounded rectangle and/or oblong between two substantially parallel rows of knitting pegs.

In general, examples of the looms discussed herein may include a non-circular knitting loom having an orifice between two substantially parallel rows of knitting pegs and at least one knitting peg at an end of the loom between the two substantially parallel rows of knitting pegs. In another example, the plurality of knitting pegs may be spaced equidistant relative to one another around the loom. The loom may be configured as, but not limited to, having a rectangular, elliptical, oblong, oval, or rounded rectangle shape. The loom may also have a knitting peg at one or more ends between the two substantially parallel rows of knitting pegs. In addition, a loom clip may be used instead or in place of the end-pegs.

As used herein, "yarn" means any conventional flexible material suitable for weaving, such as commercially available twines and yarn. Also, as used herein, "substantially equidistant" means that any two adjacent knitting pegs are spaced apart by a substantially equal distance. "Substantially equidistant" also refers to the position of a knitting peg at one or more ends of the base structure relative to either of the two substantially parallel rows of knitting pegs, wherein the deviation from equal distance is less than twice the spacing of any two adjacent knitting pegs.

The substantially non-circular base structure of the loom may include, but is not limited to, the following shapes: an ellipse, an oblong, a rectangle, a rounded rectangle or an oval. In addition, the substantially non-circular base structure of the invention includes an orifice having a long axis and a short axis.

In an example, the knitting pegs are detachably connected to the loom. For example, the knitting pegs may be generally cylindrical in shape, having a top end and a bottom end, wherein the bottom end is configured to connect to a hole in the base structure. Optionally, the knitting pegs may have a groove or channel starting at or near the top end of the knitting peg and running to the bottom end or near the bottom end of the knitting peg. Alternatively, a reconfigurable loom clip may be used that allows the user to place a peg at a location of choice to re-size the loom.

In an example, with reference to FIGS. 1-4, a loom clip 100 is shown having a knitting peg 110 attached to a main body 120. Also attached to the main body are location pegs 130, 132, and snap features 140, 142. In general, loom clip 100 is movable and locatable along a knitting loom configured to receive it (see FIG. 5). By allowing the user to move loom clip 100, different sized objects may be knitted using the same loom where the dimension of the knitted object may be controlled by the position of knitting peg 110. Location pegs 130, 132 are received by the loom and allow the user to place loom clip 100 at standardized locations. Snap features 140, 142 allow loom clip 100 to be secured to the loom. Main body 120, including snap features 140, 142 are typically made from rigid materials but also allow for some flex of snap features 140, 142 allowing the user to attach and detach loom clip 100 from a knitting loom.

Figure 5:
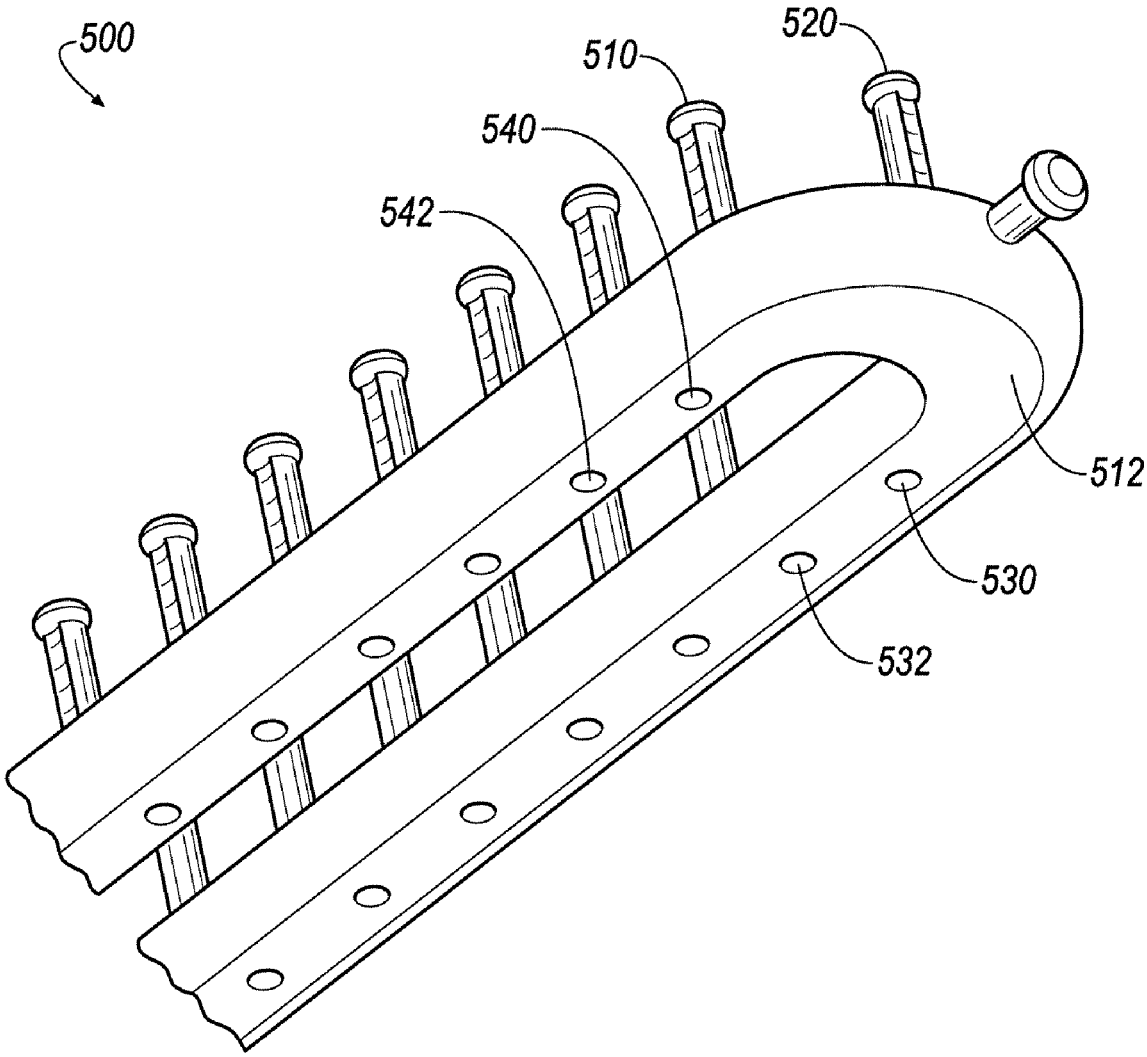
FIG. 5 is a bottom perspective view of a knitting loom for use with the loom clip of FIG. 1.

FIG. 5 is a bottom perspective view of a knitting loom 500 for use with the loom clip of FIG. 1. Loom 500 includes a plurality of pegs 510 attached to a base structure 512, including an end-peg 520 used for knitting. A plurality of holes are placed on the bottom side of loom 500 to receive loom clip 100 (shown in FIG. 1-4). The holes are shown as hole pairs 530 and 540, as well as pairs 532, 542. Each of the holes are configured to receive location pegs 130, 132. The plurality of holes 530, 540, 532, 542 allow for the reconfigurable placement of loom clip 100.

Figure 6:
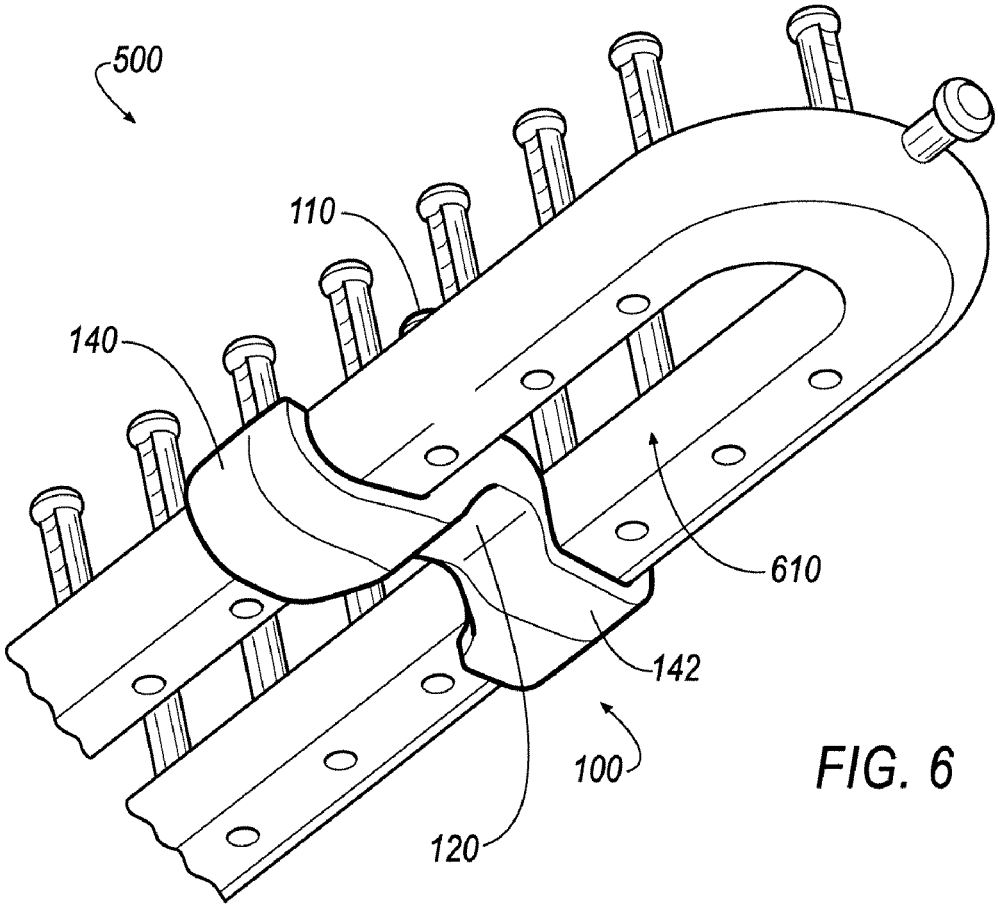
FIG. 6 is a bottom perspective view of the loom clip of FIG. 1 in use with the loom of FIG. 5.
Figure 7:
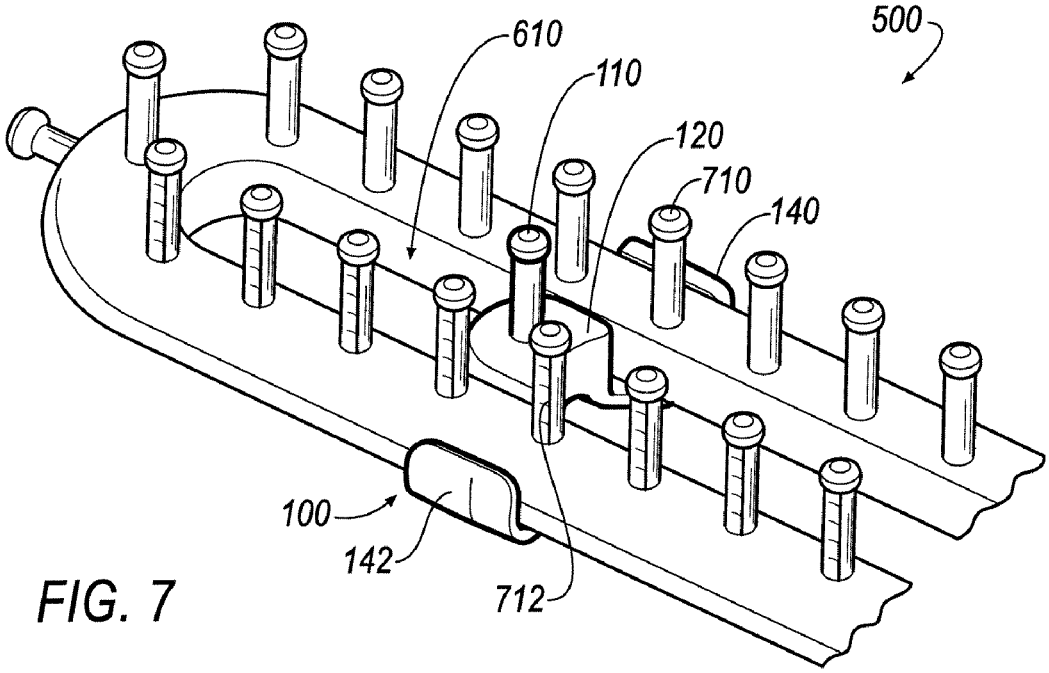
FIG. 7 is a top perspective view of the loom clip of FIG. 1 in use with the loom of FIG. 5.

FIG. 6 is a bottom perspective view of loom clip 100 in use with loom 500. Main body 120 of loom clip 100 fits within an opening 610 of loom 500 and may be considered a cross-bridge between the sides of loom 500. Snap features 140, 142 interfere with loom 500 when main body 120 is pressed through opening 610 to make a positive connection. The shape of loom 500 and the shape of snap features 140, 142 provide for rigid communication therebetween when attached.

Location pegs 130, 132 (not shown) are received by holes (not shown), such as holes 530, 540, 532, 542 to positively locate loom clip 100, and in particular peg 110, relative to the other pegs such as pegs 710, 712. The location of the plurality of holes (such as holes 530, 540, 532, 542) and the location of peg 110 relative to location pegs 130, 132 provide for accurate placement of peg 110 relative to the fixed pegs of loom 500.

Figure 8A:
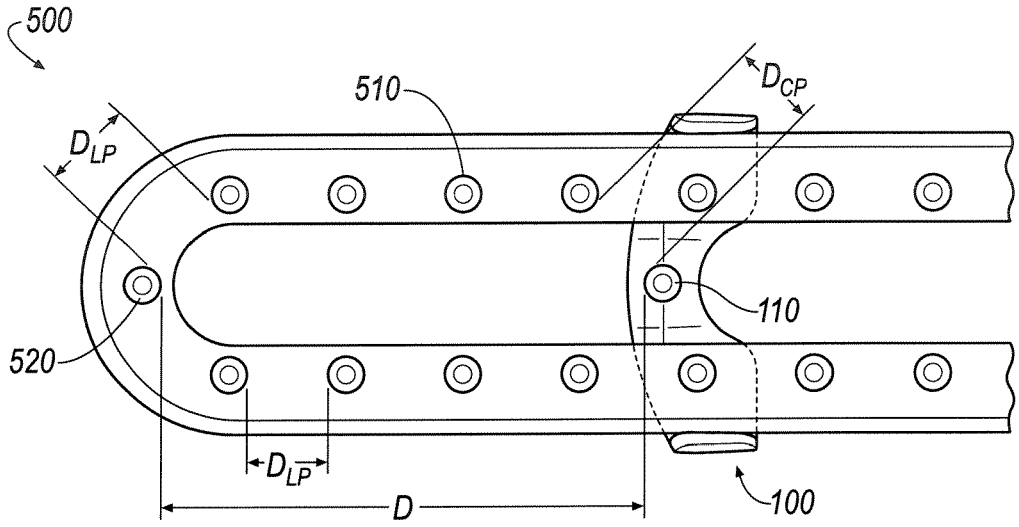
FIGS. 8A-8C illustrate a plurality of top views of the loom clip of FIGS. 1-4 in use with the loom of FIGS. 5-7.
Figure 8B:
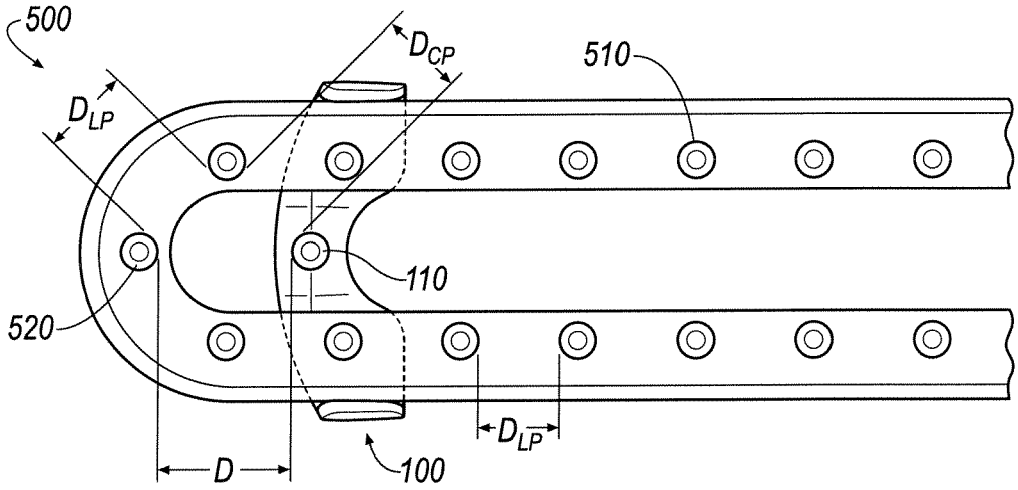
Figure 8C:
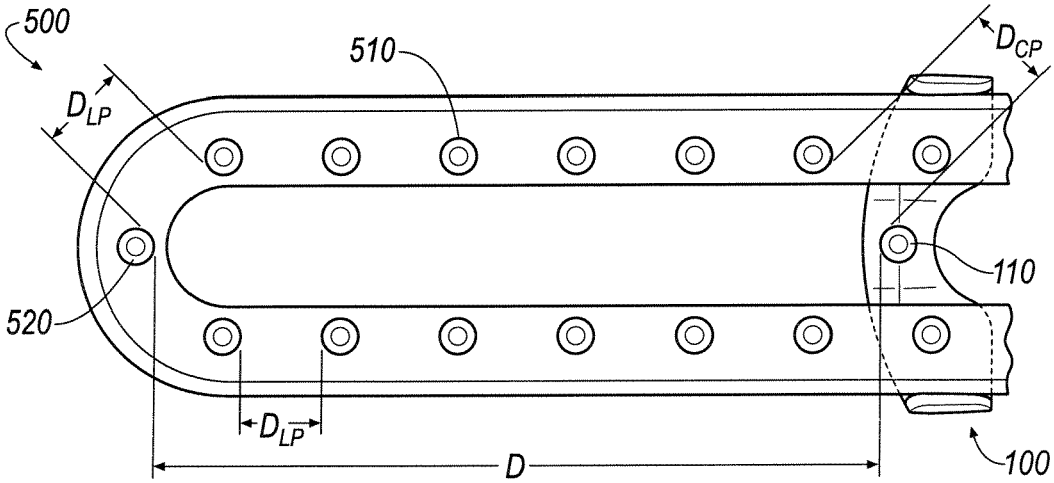

Referring to FIGS. 8A-8C, each of the plurality of pegs 510, 520 are equidistantly spaced, as shown at $D_{LP}$, The introduction of loom clip 100 places the peg 110 at a same distance, $D_{CP}$, as that of the distance, $D_{LP}$, of the equidistantly-spaced plurality of pegs 510, 520 of the loom 500. Therefore, upon reconfigurably-positioning the loom clip 100 relative the loom 500, the peg 110 of the loom clip 100 acts as an adjustable end peg that functions in a substantially similar manner as the end peg. By allowing for the movable placement of the peg 110 relative the loom 500, the user may be capable of knitting different sized objects using a single loom 500. For example, when the user desires to knit an object of a particular size, the user determines the outer perimeter length (e.g., the circumference) of the object and places loom clip 100 in the appropriate location relative the loom 500 in order to place the peg 110 at a correct distance, D, away from the location of the fixed end peg 520 to make that perimeter length. In this way, the user may simply move the peg 110 (via a new location of the loom clip 100 relative the loom 500) to determine the size of the knitted object.

As will be recognized by a person of ordinary skill in the art, the base structure may be of any desirable size and may contain any number of knitting pegs spaced equidistant around the base structure. In addition, the looms of the invention may be made of any suitable material, such as wood, plastic, rubber, or metal.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. The embodiments should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

With regard to the processes, methods, heuristics, etc. described herein, it should be understood that although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes described herein are provided for illustrating certain embodiments and should in no way be construed to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A loom that receives a body including an end peg, comprising:

a base structure defining an upper surface and a lower surface, wherein the base structure defines a first elongated base member, a second elongated base member, wherein the lower surface of each of the first and second elongated base members define a plurality of hole pairs, wherein a first hole of each of the plurality of hole pairs is defined by the lower surface of the first elongated base member, wherein a second hole of each of the plurality of hole pairs is defined by the lower surface of the second elongated base member, at least one bridge portion that clenchingly connects the first elongated base member to the second elongated base member, and a plurality of knitting pegs, wherein the plurality of knitting pegs define a first row of knitting pegs extending substantially orthogonally away from the upper surface defined by the first elongated base member, wherein the plurality of knitting pegs further define a second row of knitting pegs extending substantially orthogonally away from the upper surface defined by the second elongated base member, wherein the first and second rows of knitting pegs are arranged substantially parallel to one another, wherein one of the plurality of knitting pegs is a fixed end peg that extends from the upper surface defined by the bridge portion, wherein the fixed end peg is positioned between the first and second rows of knitting pegs.

2. The loom according to claim 1, wherein each knitting peg of the plurality of knitting pegs is equidistantly-spaced.

3. The loom according to claim 1, wherein the first hole and the second hole of each hole pair of the plurality of hole pairs define means for providing one standardized location of a plurality of a standardized locations for receivably-coupling the body to the loom for permitting selectively-adjustable positioning of the body relative the loom.

4. A reconfigurable loom device, comprising:

a body defining a top surface and a bottom surface, wherein the body includes a first knitting end peg extending substantially orthogonally away from the top surface, and a pair of locating pegs extending substantially orthogonally away from the top surface; and a loom defining an upper surface and a lower surface, wherein the loom includes a first elongated base member, a second elongated base member, wherein the first and second elongated base members are arranged substantially in parallel to define an elongated opening therebetween, wherein the lower surface of each of the first and second elongated base members define a plurality of hole pairs, and a second knitting end peg extending substantially orthogonally away from the upper surface, wherein the body is removably-coupled to the loom by disposing the pair of locating pegs within one hole pair of the plurality of hole pairs, wherein the first knitting end peg of the body extends through the elongated opening defined by the first and second elongated members, wherein the first knitting end peg of the body is selectively-spaced at a distance away from the second knitting end peg of the loom.

5. The reconfigurable loom device according to claim 4, wherein the loom includes at least one bridge portion that connects the first elongated base member to the second elongated base member, wherein second knitting end peg is a fixed end peg that extends from the upper surface defined by the bridge portion.

6. The reconfigurable loom device according to claim 4 further comprising a plurality of knitting pegs, wherein the plurality of knitting pegs define a first row of knitting pegs extending substantially orthogonally away from the upper surface defined by the first elongated base member, wherein the plurality of knitting pegs further define a second row of knitting pegs extending substantially orthogonally away from the upper surface defined by the second elongated base member, wherein the first and second rows of knitting pegs are arranged substantially in parallel to one another, wherein the first and second knitting end pegs are positioned between the first and second rows of knitting pegs.

7. The reconfigurable loom device according to claim 6, wherein the plurality of knitting pegs, the first knitting end peg, and the second knitting end peg are equidistantly-spaced.

8. The reconfigurable loom device according to claim 4, wherein the body defines a main body having a top portion, a first side portion extending substantially perpendicularly away from the top portion, a second side portion extending substantially perpendicularly away from the top portion, wherein the first knitting end peg extends substantially orthogonally away from the upper surface defined by the top portion;

a first wing portion extending away from the first side portion of the main body, wherein the first wing portion includes a first location peg of the pair of location pegs, wherein the first location peg extends substantially orthogonally away from the upper surface defined by the first wing portion; and a second wing portion extending away from the second side portion of the main body, wherein the second wing portion includes a second location peg of the pair of location pegs, wherein the first location peg extends substantially orthogonally away from the upper surface defined by the second wing portion.

9. The reconfigurable loom device according to claim 4, wherein the first hole and the second hole of each hole pair of the plurality of hole pairs define means for providing one standardized location of a plurality of a standardized locations for receivably-coupling the body to the loom for permitting selectively-adjustable positioning of the body relative the loom.

10. The reconfigurable loom device according to claim 9, wherein the first and second location pegs define means for adjustably-locating the body relative the loom at one of the plurality of a standardized locations defined by the plurality of hole pairs.

11. The reconfigurable loom device according to claim 10, wherein the adjustability of the body relative the loom results in the body defining means for adjustably-locating the first knitting end peg relative the loom at one of the plurality of standardized locations.

12. The reconfigurable loom device according to claim 8 further comprising a first arcuate portion extending away from the first wing; and a second arcuate portion extending away from the second wing, wherein the first and second arcuate portions define means for securing the body to the loom.

13. The reconfigurable loom device according to claim 12, wherein the body includes a flexibly-rigid material that permits a snap-fit attachment of the body to the loom without the use of a fastener.

14. The reconfigurable loom device according to claim 4, wherein the top surface of the body is located substantially adjacent the lower surface of the loom.

15. The reconfigurable loom device according to claim 4, wherein the top surface of the body is substantially co-planar with the upper surface of the loom.

16. An apparatus removably-connectable to a loom, comprising:

a body defining an upper surface and a lower surface, wherein the body defines a main body having a top portion, a first side portion extending substantially perpendicularly away from the top portion, a second side portion extending substantially perpendicularly away from the top portion, and a knifing peg extending substantially orthogonally away from the upper surface defined by the top portion;

a first wing portion extending away from the first side portion of the main body;

a second wing portion extending away from the second side portion of the main body, wherein at least one of the first and second wing portions include one or more location pegs extending substantially orthogonally away from the upper surface defined by one or more of the first and second wing portions.

17. The knitting loom clip of claim 16, wherein the body comprises two snap features configured to hold said rigid member in communication with a knitting loom.

18. The knitting loom clip of claim 16, wherein the body is configured to clasp a knitting loom.

19. The apparatus according to claim 16, wherein the first wing portion includes a first location peg of the one or more location pegs extending substantially orthogonally away from the upper surface defined by the first wing portion, wherein the second wing portion includes a second location peg of the one or more location pegs extending substantially orthogonally away from the upper surface defined by the second wing portion, wherein the first and second location pegs define means for adjustably-locating the body relative the loom at one of a plurality of a standardized locations.

20. The apparatus according to claim 19, wherein the knitting peg is an end peg, wherein the adjustability of the body relative the loom results in the body defining means for adjustably-locating the end peg relative the loom at one of the plurality of standardized locations.

21. The apparatus according to claim 19 further comprising a first arcuate portion extending away from the first wing; and a second arcuate portion extending away from the second wing, wherein the first and second arcuate portions define a means for securing the body to the loom.

22. The apparatus according to claim 21, wherein the body includes a flexibly-rigid material that permits a snap-fit attachment of the body to the loom without the use of a separate fastener.

* * * * *